US007201665B2

(12) United States Patent
Van Etten

(10) Patent No.: US 7,201,665 B2
(45) Date of Patent: Apr. 10, 2007

(54) POOL CUE TIP REPAIR DEVICE

(76) Inventor: Bernie Van Etten, 7059 Nonpareil Rd., Southerlin, OR (US) 97479

( * ) Notice: Subject to any disclaimer, the term of this patent is extended or adjusted under 35 U.S.C. 154(b) by 0 days.

(21) Appl. No.: 10/448,177

(22) Filed: May 30, 2003

(65) Prior Publication Data

US 2004/0072623 A1 Apr. 15, 2004

Related U.S. Application Data

(60) Provisional application No. 60/384,106, filed on May 31, 2002.

(51) Int. Cl.
*A63D 15/12* (2006.01)

(52) U.S. Cl. ..... 473/50

(58) Field of Classification Search ..... 473/49, 473/50

See application file for complete search history.

(56) References Cited

U.S. PATENT DOCUMENTS

| | | | | |
|---|---|---|---|---|
| 153,433 | A * | 7/1874 | Fuller | 473/50 |
| 165,562 | A * | 7/1875 | Gravelius | 473/50 |
| 546,225 | A * | 9/1895 | Clark | 473/50 |
| 566,504 | A * | 8/1896 | Davis et al. | 473/50 |
| 589,225 | A * | 8/1897 | Schoenleber | 473/50 |
| 674,732 | A * | 5/1901 | Dorticus | 473/50 |
| 934,691 | A * | 9/1909 | Patterson | 473/50 |
| 1,131,111 | A * | 3/1915 | Broberg | 473/50 |
| 6,363,595 | B1 | 4/2002 | Roy | 29/263 |

FOREIGN PATENT DOCUMENTS

| | | | |
|---|---|---|---|
| DE | 66639 | * | 1/1893 |
| DE | 274680 | * | 5/1914 |

OTHER PUBLICATIONS

Five (5) photographs of a prototype pool cue tip repair device known to Applicant prior to filing of the present application.

* cited by examiner

*Primary Examiner*—Mark S. Graham
(74) *Attorney, Agent, or Firm*—Miles & Stockbridge PC

(57) ABSTRACT

A pool cue tip repair apparatus comprises a cue clamp including a pair of opposing jaws having mating recesses defining a passage adapted to grip a pool cue stick, and a clamping device adapted to apply the jaws to the pool cue stick; and a tip clamp member detachably mountable on the cue clamp and having an operating screw axially oriented so as to be generally parallel with a longitudinal axis of the passage.

11 Claims, 2 Drawing Sheets

POOL CUE TIP REPAIR DEVICE

CROSS-REFERENCE TO RELATED APPLICATIONS

This application claims the benefit of Provisional Application No. 60/384,106 filed May 31, 2002, incorporated herein by reference.

BACKGROUND OF THE INVENTION

1. Field of Invention

This invention relates to pool cue tip repair devices.

2. Description of Related Art

After a period of use, a pool cue tip often becomes worn or damaged and is no longer desirable to be used. Conventional and commercially available devices to replace these tips have several disadvantages. Particularly, these devices generally include a clamp that is affixed to the cue stick by rings, which are forced on the wood portion of the cue stick to hold the device tight against the cue stick. These types of devices may damage the cue stick by exerting excessive pressure on the wood.

SUMMARY OF THE INVENTION

The present invention overcomes the deficiencies of the prior art. The present invention provides an effective and efficient means for repairing a cue tip that does not damage the cue stick and that properly aligns the cue tip on the cue stick.

These and other features and advantages of this invention are described in or are apparent from the following detailed description of an exemplary embodiment of a pool cue tip repair device according to this invention.

BRIEF DESCRIPTION OF THE DRAWINGS

An exemplary embodiment will be described in detail, with reference to the following figures, wherein.

DETAILED DESCRIPTION OF PREFERRED EMBODIMENTS

Figure 1:
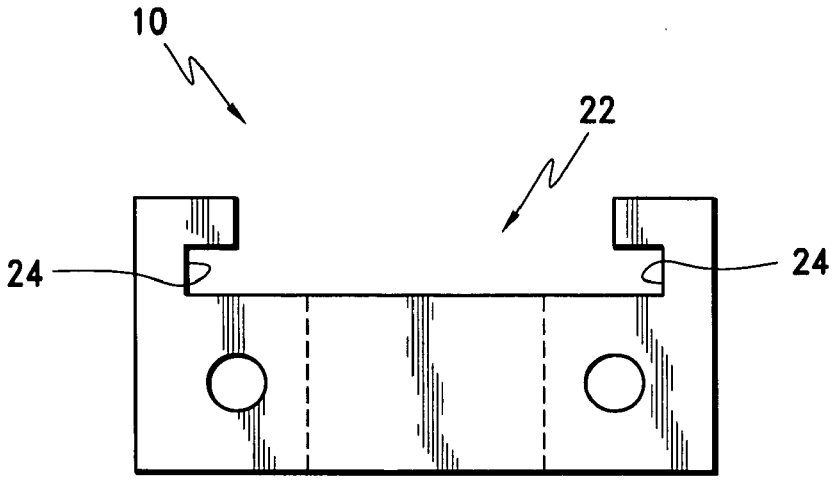
FIG. 1 is a front view of a cue clamp of a cue tip repair device, according to the present invention.
Figure 2:
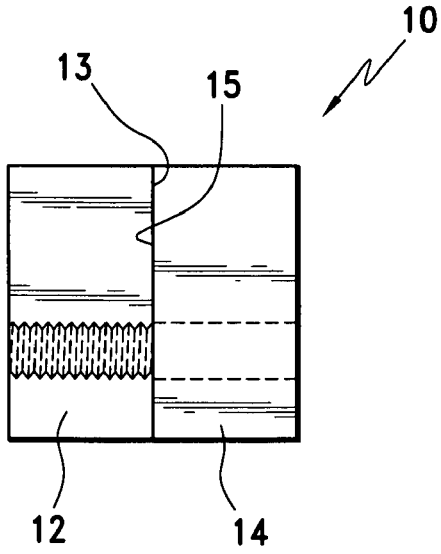
FIG. 2 is a side view of the cue clamp of FIG. 1.
Figure 3:
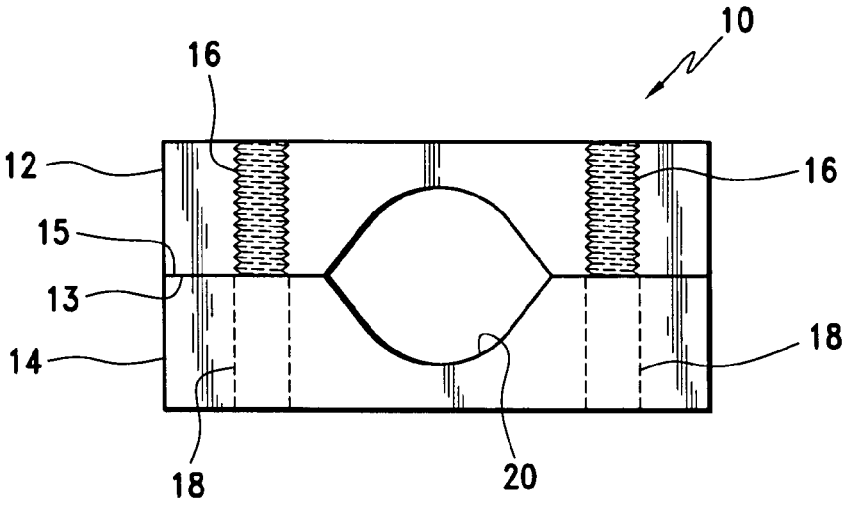
FIG. 3 is a bottom view of the cue clamp of FIG. 1.
Figure 4:
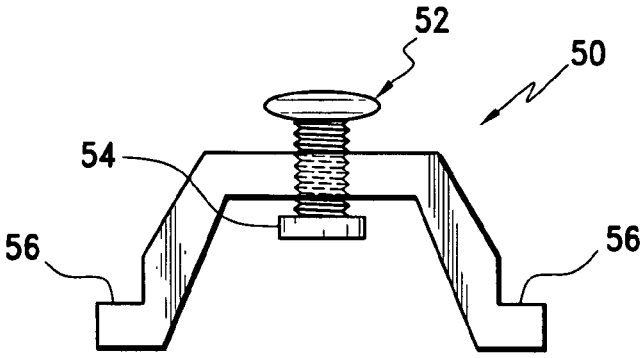
FIG. 4 is a front view of a tip clamp member of the cue tip repair device, according to the invention.
Figure 5:
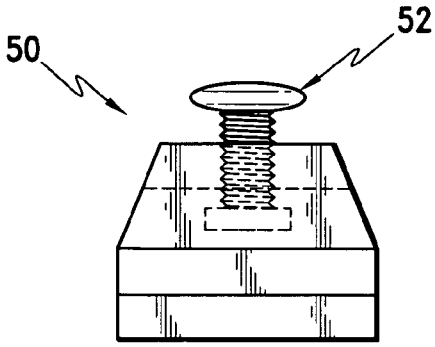
FIG. 5 is a side view of the tip clamp member of FIG. 4.

The present invention is directed to a pool cue tip repair device including a cue clamp 10 and a tip clamp member 50. A preferred construction of the cue clamp 10 is illustrated in FIGS. 1–3, and a preferred construction of the tip clamp member 50 is illustrated in FIGS. 4 and 5. The cue clamp 10 is configured to receive the tip clamp member 50, as will be described below.

The cue clamp 10 includes a first jaw 12 and a second jaw 14. First and second jaws 12 and 14 include opposing surfaces 13 and 15, respectively. The first and second jaws also include opposing bores 16 and 18, respectively. Preferably, the bores 16 and 18 are substantially perpendicular to the respective surfaces 13 and 15. The surfaces 13 and 15 are held adjacent each other by bolts or screws, not shown, via the bores 16 and 18. Preferably, the bores 16 are threaded, and the bolts or screws extend through the opposing bores 18 to engage the threaded bores 16.

When held adjacent to each other, the first and second jaws 12 and 14 define a passage 20. The passage 20 is configured to receive a ferrule attached to an end of a pool cue stick, not shown. The cue clamp 10 may be selectively tightened onto the ferrule, which is coaxial with the cue stick, by tightening the bolts or screws that hold the first and second jaws 12 and 14 together. It is preferred that the longitudinal axis of the passage 20 be substantially perpendicular to the axes of the bores 16 and 18. The passage 20 is preferred to be generally oblong shaped in cross-section, so that it can accommodate cylindrical ferrules of different diameters.

The tip clamp member 50 includes an operating screw 52, which is a thumbscrew in the form shown. Operating screw 52 is provided with a plate-like tip portion 54 constituting a jaw for engaging the pool cue tip.

A retaining channel 22 is formed at the top of the cue clamp 10. The retaining channel 22 has groove portions 24 formed on both the first and second jaws 12 and 14 and is suitably configured to receive the tip clamp member 50. The retaining channel 22 is generally T-shaped in cross-section in the form shown in FIG. 1. The laterally extending groove portions 24 of channel 22 receive the tip clamp member 50, wherein the tip clamp member 50 may be slid within the groove portions 24.

The tip clamp member 50 includes engagement flanges 56, which are operably configured to slidably engage the groove portions 24.

When the tip clamp member 50 is fully engaged in the retaining channel 22, the operating screw 52 is preferably coaxially aligned with the passage 20 and the tip clamp member 50 is held against the cue clamp 10. It should be appreciated that either the tip clamp member 50 or the cue clamp 10 may be configured with a means to set the distance (along the longitudinal axes of the groove portions 24) that the tip clamp member 50 will slide so as to ensure proper alignment of the operating screw 52 with the longitudinal axis of the passage 20. For example, a series of stops or an adjustable stop may be provided so that the distance may be set in correspondence with different ferrule diameters.

The retaining channel 22 and the tip clamp member 50 are configured such that the tip clamp member 50 may only be removed from the retaining channel 22 by sliding the tip clamp member 50 out of the groove portions 24. It is preferred that the groove portions 24 extend substantially parallel to the axes of the bores 16 and 18.

When a new cue tip is placed on a cue stick, the cue tip is adhered to a ferrule attached to an end of the cue stick. The repair device of the present invention provides proper attachment of the cue tip to the ferrule without damaging the cue stick. Specifically, the flanges 56 of the tip clamp member 50 will slidably engage the groove portions 24 of the retaining channel 22. A cue stick with a new cue tip provisionally attached to a ferrule by a not-yet dried adhesive is then inserted into the passage 20. The cue clamp 10 is tightened so that it is firmly held against the ferrule (typically the surfaces 13 and 15 will be spaced from one another in this condition by a distance depending on the diameter of the ferrule, which determines the points of engagement with the walls of passage 20). The operating screw 52 is actuated to engage the plate-like tip portion 54 with the new cue tip so as to apply pressure in a direction corresponding to the axis of the cue stick. With this arrangement the repair device according to the invention provides proper alignment between the new cue tip, relative to the cue stick, while the adhesive dries. Additionally, because the surface of the passage 20 engages the ferrule and not the cue stick, the repair device of the invention will not damage the surface of the stick. In practice, depending on the user's preference, the cue clamp 10 may be applied to the ferrule before or after a new tip is placed on the ferrule, and the tip clamp member 50 may similarly be mounted to the cue clamp 10 with or without the new tip having been mounted to the ferrule.

While this invention has been described in conjunction with the specific embodiment outlined above, it is evident that many alternatives, modifications and variations will be apparent to those skilled in the art. Accordingly, the embodiment of the invention, as set forth above, is intended to be illustrative, but not limiting. Various changes may be made without departing from the spirit and scope of this invention.

I claim:

1. A pool cue tip repair apparatus comprising:

a cue clamp including a pair of opposing jaws having mating recesses defining a passage adapted to grip a ferrule attached to an end of a pool cue stick without said passage engaging the pool cue stick, and a clamping device adapted to apply said jaws to said ferrule, said passage having a longitudinal axis, and a tip clamp member detachably mountable on said cue clamp and having an operating screw axially oriented so as to be generally parallel with said longitudinal axis of said passage, wherein said cue clamp has a retaining channel for mounting said tip clamp member thereon, and wherein, as viewed in a direction perpendicular to said longitudinal axis of said passage, said retaining channel is T-shaped, having laterally extending grooves.

2. The pool cue tip repair apparatus of claim 1, wherein said tip clamp member includes engagement flanges configured to engage said grooves.

3. The pool cue tip repair apparatus of claim 1, wherein said passage has a non-circular cross-section.

4. The pool cue tip repair apparatus of claim 1, wherein said passage has an oblong cross-section.

5. The pool cue tip repair apparatus of claim 1, wherein said passage has a circular cross-section.

6. The pool cue tip repair apparatus of claim 1, wherein said clamping device includes at least one screw which passes though an unthreaded bore in one of said pair of jaws and threadably engages a threaded bore in the other of said pair of jaws.

7. The pool cue tip repair apparatus of claim 6, wherein said clamping device includes a pair of screws which pass though unthreaded bores in one of said pair of jaws and threadably engage threaded bores in the other of said pair of jaws.

8. The pool cue tip repair apparatus of claim 7, wherein said bores are substantially perpendicular to said longitudinal axis of said passage.

9. The pool cue tip repair apparatus of claim 2, wherein said retaining channel is configured to receive said engagement flanges by insertion of said engagement flanges into open ends of said grooves.

10. The pool cue tip repair apparatus of claim 1, wherein said retaining channel is disposed on a top of said cue clamp.

11. The pool cue tip repair apparatus of claim 10, wherein said grooves are defined by opposed bent portions of said cue clamp.

* * * * *